United States Patent [19]

Tibbetts

[11] 4,390,030

[45] Jun. 28, 1983

[54] ASHTRAY

[76] Inventor: Forest S. Tibbetts, 16 SW. 13 St., Ft. Lauderdale, Fla.

[21] Appl. No.: 328,855

[22] Filed: Dec. 9, 1981

Related U.S. Application Data

[63] Continuation-in-part of Ser. No. 125,215, Feb. 27, 1980, abandoned.

[51] Int. Cl.[3] ..... A24F 19/00

[52] U.S. Cl. ..... 131/231; 131/242

[58] Field of Search ..... 131/231, 242; D27/8, D27/10, 28, 29

[56] References Cited

U.S. PATENT DOCUMENTS

| | | | |
|---|---|---|---|
| D. 102,268 | 1/1937 | Dennis | 131/231 |
| D. 119,206 | 2/1940 | Sandejas | 131/242 |
| D. 170,177 | 8/1953 | Wood | 131/231 X |
| 1,364,893 | 1/1921 | Schulte et al. | 131/242 |
| 1,756,760 | 4/1930 | Reich | 131/231 |

*Primary Examiner*—Stephen C. Pellegrino

*Attorney, Agent, or Firm*—Malin & Haley

[57] ABSTRACT

An ashtray having an upper opening smaller than the internal compartment. The internal compartment stores cigarette ashes and includes a cigarette holding device. The cigarette when placed in the holding device is positioned completely within the internal compartment below the upper opening. The upper opening is sized larger than a large cigarette in order that it may be placed in the cigarette holder position below the plane of the upper opening and the opening is sized smaller in area than the lower area. In the preferred embodiment, from the perimeter of the upper opening of the cigarette ashtray to an intermediate portion the inner surface slopes outwardly as well as downwardly to the maximum outer perimeter. The ashtray is designed and sized to prevent the ashes from being blown directly out of the ashtray by winds passing over the upper opening and places a cigarette held by the holder to be positioned completely below the perimeter of the upper opening. The design allows the ashes that are lifted from the bottom of the ashtray to engage the upper roof-like cover and then to drop back down into the ashtray.

2 Claims, 6 Drawing Figures

Fig. 1.
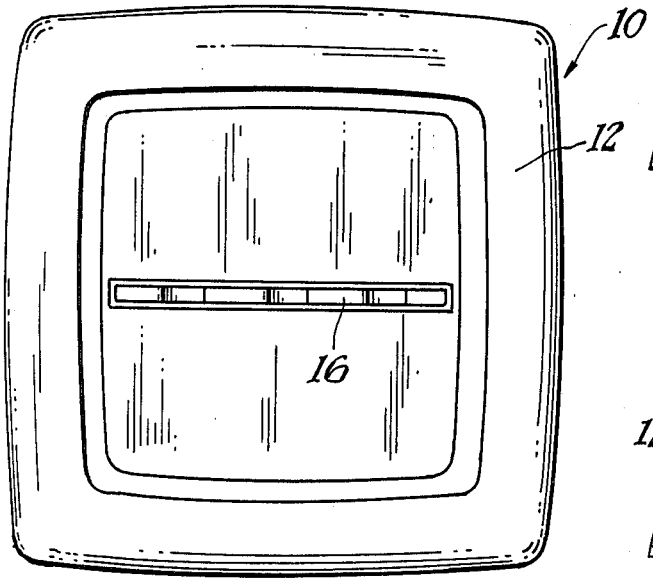
Fig. 5.
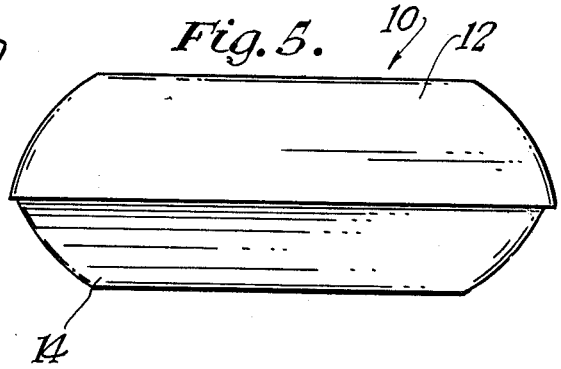
Fig. 6.
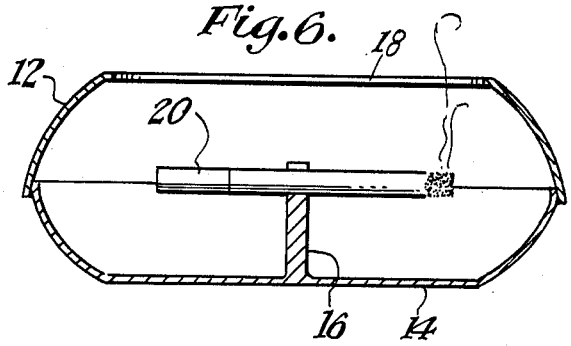
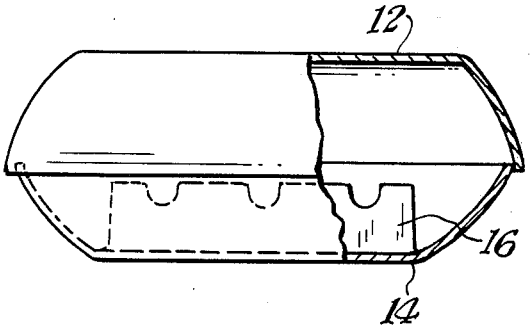
Fig. 4.
Fig. 3.
Fig. 2.
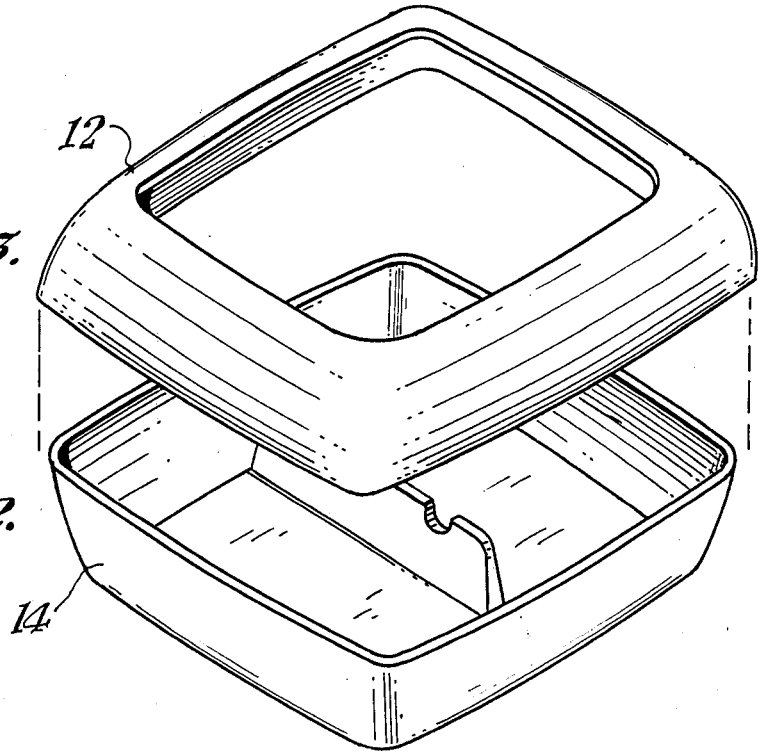

ASHTRAY

This is a continuation-in-part of application Ser. No. 06/125,215, filed Feb. 27, 1980 now abandoned.

BACKGROUND OF THE INVENTION

This invention relates to cigar, cigarettes and ash receivers and more particularly to an open top ashtray which retains the ashes therein even with air currents passing over the opening of the ashtray and will hold the entire cigar or cigarette below the open top.

In the past, there have been various cigar, cigarette and ash receivers. By way of example is U.S. Pat. No. 1,364,893 in which a cigar, cigarette, and match holder and ash receiver is illustrated. However, this device would leave a cigar exposed to winds or other air flow and allow the ashes to be blown away from the receptacle.

Another example is shown by way of U.S. Pat. No. 1,756,760 in which an ashtray or smoker's stand is illustrated. This invention is primarily designed to retain smoke from escaping when a burning cigarette or cigar is deposited therein. There appears to be no way to hold a cigarette, with a device to keep the ashes from blowing away from the container when a cigarette is being held thereby.

The present invention overcomes the problems of the prior inventions by providing a receptacle which encloses a burning cigarette or the like and retains the ashes therein even though winds or airflow passes over the opening in the upper portion of the receptacle.

SUMMARY OF THE INVENTION

According to the present invention, an ashtray having a hollow body with an upper opening smaller than the internal compartment is provided. The internal compartment stores cigarette ashes and includes a means for holding a cigarette or cigar completely below the top opening. The upper opening is sized larger than the length of a large cigarette or the like in order that the cigarette may be placed in the cigarette holder position below the plane of the upper opening.

The ashtray includes an intermediate portion and a base portion. The sides of the intermediate portion of the ashtray projects outwardly as well as downwardly to the maximum outer perimeter, before connecting to the base portion. The outwardly and downwardly projecting sides of the intermediate portion provide a lip around the perimeter of the ashtray which prevents the ashes from being blown directly out of the ashtray by winds or airflow passing over the upper opening. Although the ashes are lifted from the bottom of the ashtray, they are retained by the lip-like intermediate portion and eventually dropped back down into the ashtray.

It is therefore an object of this invention to provide an ashtray which retains the ashes therein even though wind or air flow passes over the opening in the ashtray.

In accordance with these and other objects which will be apparent hereinafter, the instant invention will now be described with particular reference to the accompanying drawings.

BRIEF DESCRIPTION OF THE DRAWINGS

FIG. 1 is a top elevational view of the invention.

FIG. 2 is an isometric view of the lower portion of the invention.

FIG. 3 is an isometric view of the upper portion of the invention.

FIG. 4 is a front view of the invention.

FIG. 5 is a side view of the invention partially in cross-section.

FIG. 6 is a cross sectional side view showing a cigarette in the compartment below the top opening.

DESCRIPTION OF THE PREFERRED EMBODIMENT

Referring to FIG. 1, the invention is generally shown by numeral 10. The ashtray 10 comprises a top or intermediate portion 12 and a base portion 14. The inside of the base portion also has a cigarette holder or holding means 16 connected therein. The top of the cigarette holder is positioned below the top of the ashtray.

The intermediate portion 12 has an upper opening such that cigarettes or the like can be placed through the upper opening and onto a cigarette holding means 16. The intermediate portion 12 has downwardly and outwardly projecting inside surface such that the lower perimeter is larger in all directions than the perimeter of the upper opening. The bottom edge is positioned below the upper perimeter opening. The base portion 14 as shown in FIG. 2, has upwardly and outwardly projecting sides such that the outer perimeter is maximum at the upper edge. The outer perimeter of the intermediate portion 12 is somewhat larger than the outer perimeter of the base portion 14 so that the intermediate portion 12 can fit over the base portion 14. The intermediate portion 12 is so designed as to form a retaining lip around the base portion 14 so that ashes may not escape from the ashtray when wind blows across the upper opening or air passes over the upper opening. This makes the device especially conducive to use in the outdoors such as patios or on boats where breezes or increased air flow are common.

FIG. 6 shows the cigarette 20 below the top opening 18. This insures that the lit cigarette will not fall out of the top opening 18. This ashtray prevents a potential fire hazard caused by a cigarette 20 burning down to a release position when it is released from holder 16. When the burn line reaches holder 16 the frictional force that holds the cigarette is smaller and a wind can blow the cigarette out of an ordinary ashtray or it may fall out of an ordinary ashtray having no cover such as member 12.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An ashtray comprising:

a hollow body, said hollow body having an intermediate portion and a lower portion;

said intermediate portion having an upper opening means, said intermediate portion sized and shaped with a cross-sectional area larger than the cross-sectional area of said upper opening, a holding means sized for completely holding a cigarette below said upper opening means to prevent movement of cigarette out of the ashtray, said holding means connected to said body and positioned below said upper opening means, said upper opening means sized to receive a cigarette completely within said hollow body below said upper opening means;

said upper opening means sized for easy access to a cigarette in said holding means;

said intermediate portion of said hollow body having generally downwardly and outwardly projecting sides, and said lower portion having upwardly and outwardly projecting sides, such that the mid-section of said body has a larger perimeter than any other portion of said body, whereby ashes are prevented from being blown directly out of said ashtray by airflow over said upper opening means.

2. An ashtray as set forth in claim 1, wherein:

said intermediate portion is detachable from said lower portion.

* * * * *